US006870485B2

(12) United States Patent
Lujan et al.

(10) Patent No.: US 6,870,485 B2
(45) Date of Patent: Mar. 22, 2005

(54) ELECTRONIC METHOD AND APPARATUS FOR DETECTING AND REPORTING DISLOCATION OF HEAVY MINING EQUIPMENT

(76) Inventors: Kraig M. Lujan, P.O. Box 48, Somis, CA (US) 93066; Lex Lujan, 4023 W. 5650 South, Roy, UT (US) 84067

( * ) Notice: Subject to any disclaimer, the term of this patent is extended or adjusted under 35 U.S.C. 154(b) by 213 days.

(21) Appl. No.: 10/052,289

(22) Filed: Jan. 18, 2002

(65) Prior Publication Data

US 2003/0112153 A1 Jun. 19, 2003

Related U.S. Application Data

(60) Provisional application No. 60/263,933, filed on Jan. 24, 2001.

(51) Int. Cl.[7] ..... G08B 21/00

(52) U.S. Cl. ..... 340/870.16; 340/686.1; 340/686.6; 340/480

(58) Field of Search ..... 340/870.16, 693.5, 340/693.6, 686.1, 686.6, 480

(56) References Cited

U.S. PATENT DOCUMENTS

| | | | | | |
|---|---|---|---|---|---|
| 4,827,248 | A | * | 5/1989 | Crudden et al. | 340/686.6 |
| 5,159,312 | A | * | 10/1992 | Engle | 340/431 |
| 5,421,600 | A | * | 6/1995 | Jones et al. | 280/428 |
| 5,621,398 | A | * | 4/1997 | Blair et al. | 340/870.36 |
| 6,469,638 | B1 | * | 10/2002 | Johnson | 340/870.16 |
| 6,753,787 | B2 | * | 6/2004 | Cole | 340/686.1 |
| 6,774,807 | B1 | * | 8/2004 | Lehfeldt et al. | 340/686.1 |

* cited by examiner

*Primary Examiner*—Albert K Wong
(74) *Attorney, Agent, or Firm*—Gene W. Arant

(57) ABSTRACT

A method and apparatus for preventing the unexpected loss of heavy mining equipment by detecting the separation of heavy metal parts at an early stage in the separation process, and providing a warning signal in response to which the particular machine that is having the difficulty may then be shut down in a timely manner. A spring-loaded switch is sandwiched between the heavy metal parts, which upon partial separation of the parts then expands and turns on an electrical switch to activate a radio transmitter, sending an alarm signal to a receiver at a remote location.

8 Claims, 4 Drawing Sheets

ELECTRONIC METHOD AND APPARATUS FOR DETECTING AND REPORTING DISLOCATION OF HEAVY MINING EQUIPMENT

PRIORITY CLAIM

This application claims the benefit of our U.S. Provisional Application No. 60/263,933 filed Jan. 24, 2001.

FIELD OF THE INVENTION

This invention relates to the control and safety of heavy equipment used in the mining industry.

BACKGROUND OF THE INVENTION

In open-pit mining operations it is common practice to utilize very large machines. One such typical machine is a hydraulically operated digging machine or shovel that includes a huge bucket equipped with a number of metal teeth. The bucket has a leading edge on which the metal teeth are carried, and during the operation of the machine the teeth are pushed into hard earth and rock to recover the ore. The teeth are typically made of very hard steel but are replaceable because they wear down during usage.

In some such equipment a separate metal piece, called an adapter, is used to mount each tooth on the leading edge of the bucket. The adapter is also a replaceable item. In that type of equipment the adapter is attached by pins or otherwise to the leading edge of the bucket, and the tooth is attached by pins or otherwise to the adapter.

Other forms of the equipment, however, do not use a separate tooth adapter, the tooth structure then being integrally formed to include both a tooth portion and an adapter portion. The tooth structure is therefore extremely large and attached directly to the leading edge of the bucket.

A problem which has occurred from time to time is that a portion of the steel tooth structure—a steel tooth, an adapter, or some combination thereof—may become separated from the bucket to which it is normally attached, and may then be carried away with the ore in a haul truck to the ore crusher. Because of the huge size of the haul trucks a steel tooth structure weighing a ton or more can pass unnoticed into the ore crusher. The hard steel of the tooth structure cannot be easily pulverized by the crusher, with the result that the crusher itself is seriously damaged.

Such damage to the ore crusher not only requires repair of the crusher itself, but may require shutting down an entire operation, perhaps including numerous digging machines, entailing a very large financial loss before the operation can be resumed. A single shut-downs may involve a loss in excess of a million dollars.

SUMMARY OF THE INVENTION

According to the invention the unexpected loss of heavy mining equipment is prevented by detecting the separation of the metal parts at an early stage in the separation process, and providing a warning signal in response to which the particular machine that is having the difficulty may then be shut down in a timely manner.

According to the presently preferred form of the invention the detection of partial separation of the metal parts is accomplished by a spring-loaded switch sandwiched between the parts, which upon partial separation of the parts then expands and thus turns on an electrical switch to activate a radio transmitter.

DRAWING SUMMARY

DESCRIPTION OF THE PREFERRED EMBODIMENT

FIGS. 1–7

In general, the unexpected loss of a tooth structure is prevented by detecting its separation from the leading edge of the bucket, at an early stage in the separation process, and providing a warning signal to the operator's cab of the machine so as to allow the operator to shut down the machine in a timely manner.

Further according to the presently preferred form of the invention, an electromechanical transducer is in the form of a spring-loaded switch sandwiched between the metal parts, which upon partial separation of the metal surfaces expands and turns on an electrical switch to activate a radio transmitter.

An adapter presents a more serious problem to the ore crusher than does a steel tooth by itself, because a lost adapter carries a tooth with it. In present machines the adapter alone may weigh over a ton. Therefore, according to the presently preferred form of the invention the electromechanical transducer detects partial separation of an adapter from the leading edge of the bucket on which it is carried.

More specifically, the electromechanical transducer in its presently preferred form is contained within a recess in the surface of the leading edge of the bucket, and engages an inner surface of the adapter. The transducer in that position is then fully protected from the movement of earth and rock that impinges upon the surfaces of the steel tooth and adapter during the ore digging process.

Figure 1:
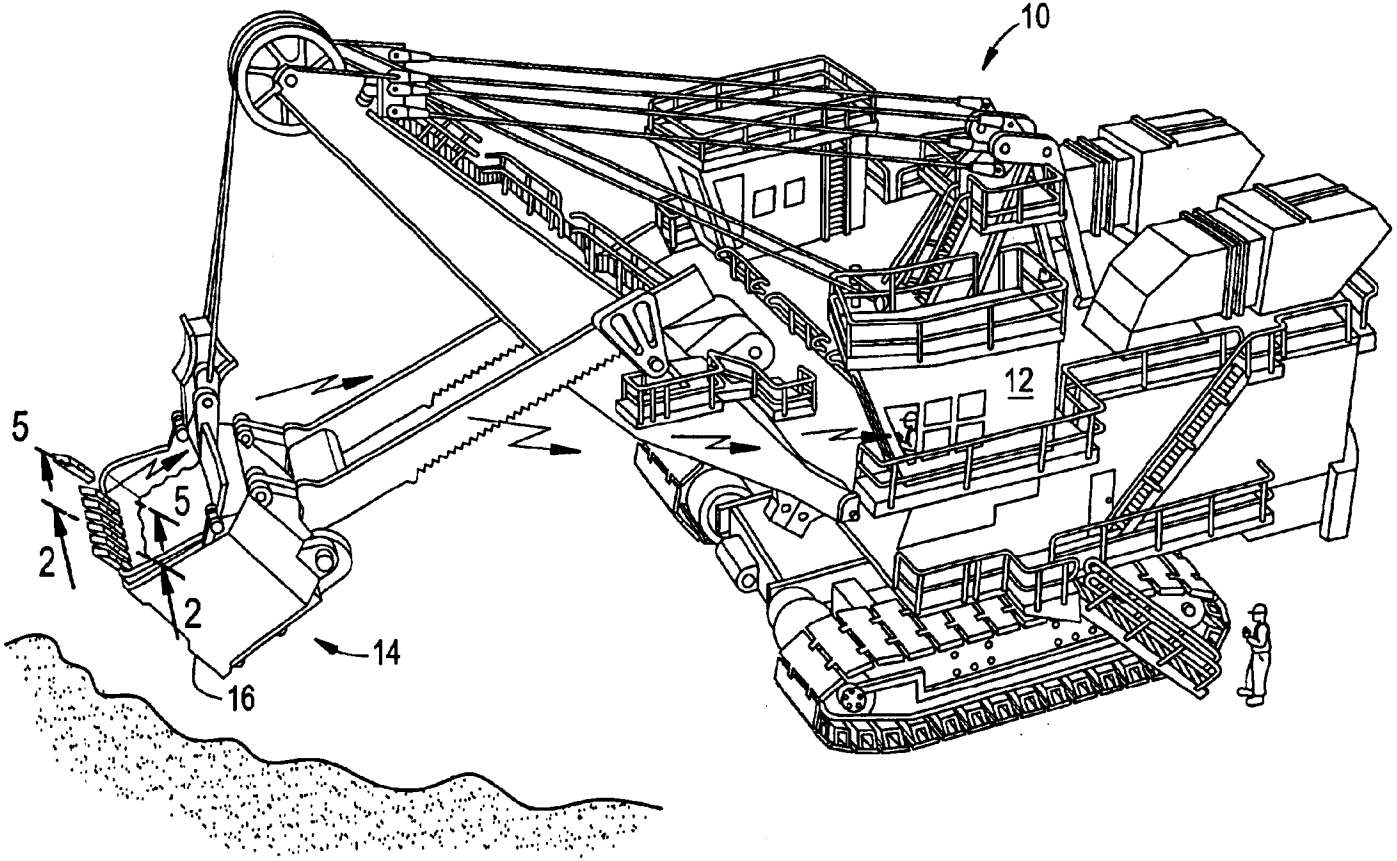
FIG. 1 is a perspective view of a typical mining shovel, with its bucket and steel teeth, one tooth for purpose of illustration being shown in a removed position.
Figure 2:
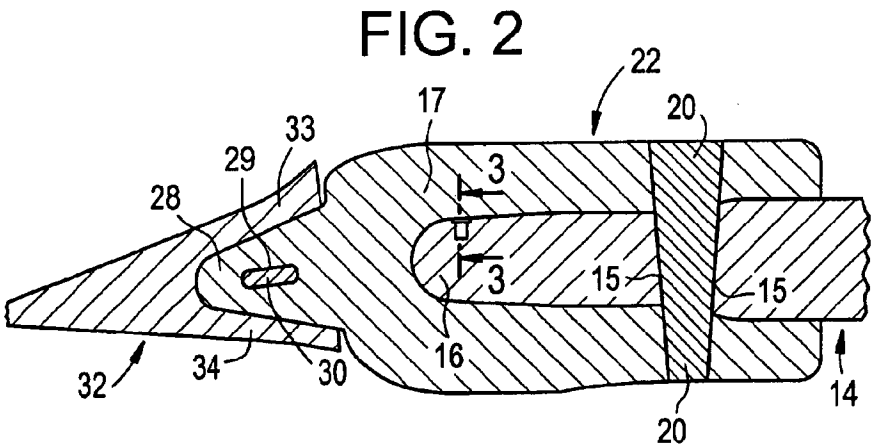
FIG. 2 is a cross-sectional elevation view taken on the line 2—2 of FIG. 1, showing the leading edge of the bucket together with an adapter and an associated steel tooth that it supports.
Figure 5:
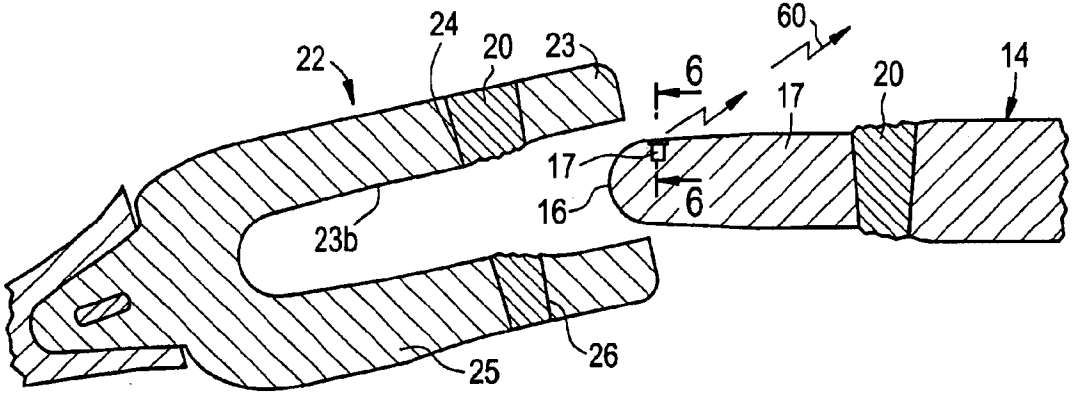
FIG. 5 is a cross-sectional view similar to FIG. 2, but showing the adapter separated from the bucket after its attachment pin has broken.

FIG. 1 shows the digging machine or shovel 10 with operator's cab 12 and bucket 14. An adapter attachment opening 15 is formed in the bucket 14 near its forward end. The leading edge of the bucket is designated as 16. Although not specifically shown in FIG. 1, the leading edge 16 of the bucket 14 carries a number of adapters 22. Each adapter 22 in turn supports a tooth 32. In a typical machine there may be as many as twelve adapters, and hence twelve teeth, carried on the bucket 14. Adapters 22 may be removed from the bucket 14 for the purpose of replacement, and teeth 32 are also removable from the adapters 22 for purpose of replacement.

The leading edge 16 of the bucket 14 has a plurality of recesses 17, one for each tooth 32. According to the presently preferred form of the invention a transducer housing assembly 40 is contained within each such recess 17.

Each adapter 22 has upper and lower legs 23, 25, which fit around the leading edge 16 of the bucket 14. Upper leg 23 has a hole 24 therethrough, while lower leg or flange 25 has a hole 26 therein. An adapter attachment pin 20 secures each adapter 22 to the leading edge 17 of bucket 14 through the aligned holes 24, 26.

Figure 3:
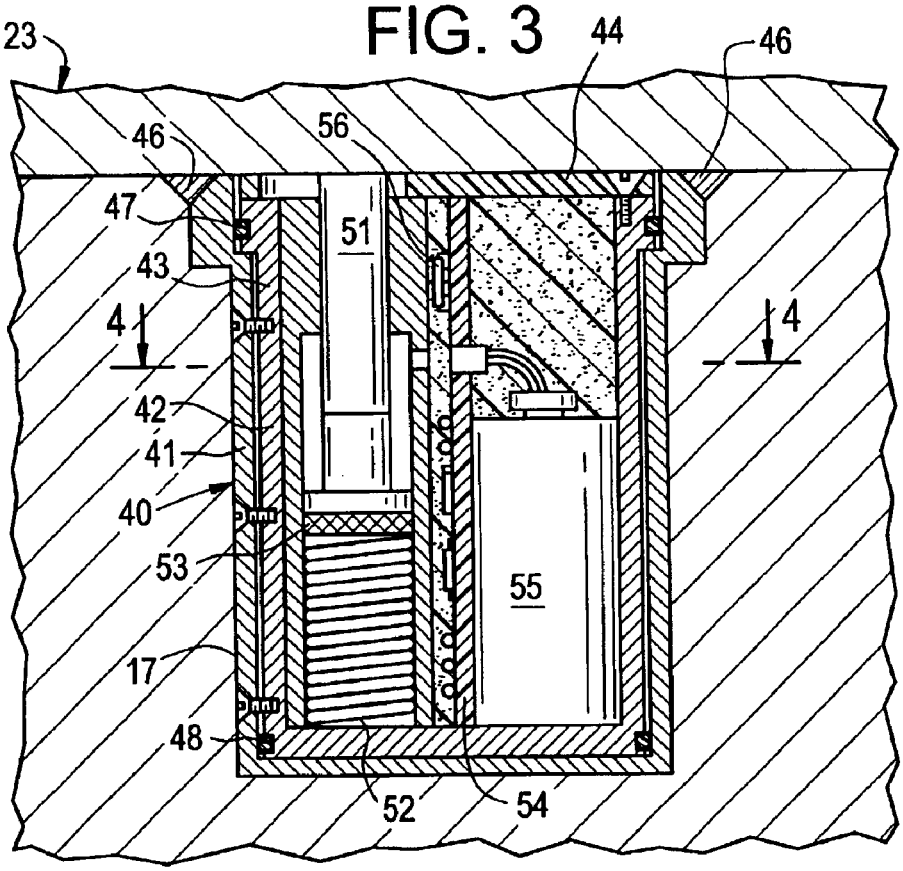
FIG. 3 is a fragmentary cross-sectional elevation view of the interengaging surfaces of the bucket leading edge and the adapter, taken on line 3—3 of FIG. 2 and showing an electromechanical transducer installed in a recess in the surface of the bucket in accordance with the present invention.
Figure 4:
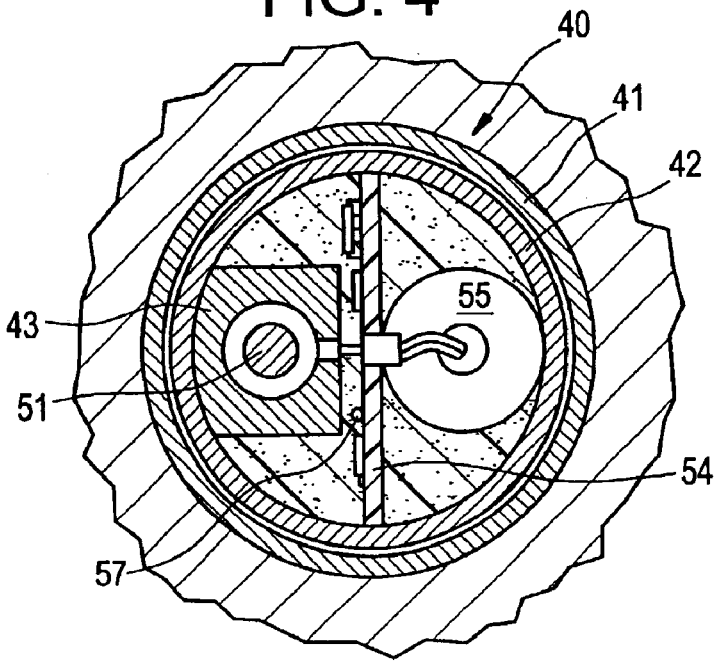
FIG. 4 is a fragmentary horizontal cross-sectional view taken on line 4—4 of FIG. 3, showing some internal details of the electromechanical transducer.
Figure 6:
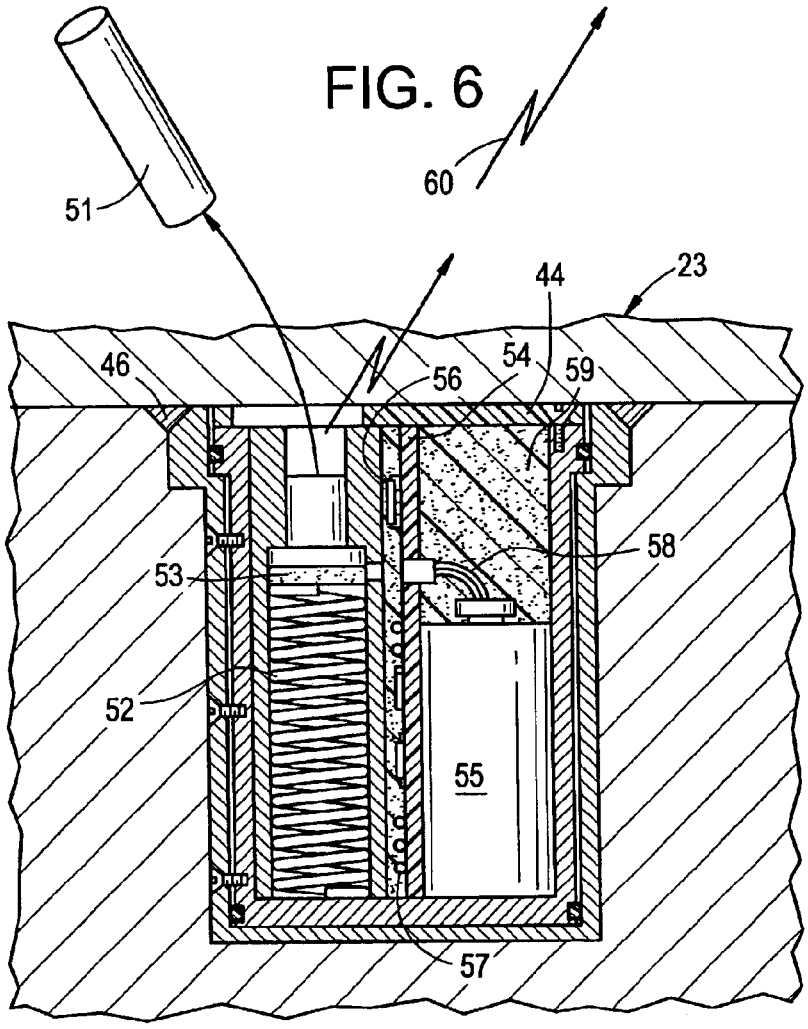
FIG. 6 is a fragmentary vertical cross-sectional view taken on the line 6—6 of FIG. 5, showing other internal details of the electromechanical transducer.

Each recess 17 in the leading edge 16 of the bucket 14 is fitted with a transducer housing assembly 40 and electromechanical transducer, as shown more in detail in FIGS. 3, 4, and 6. Of particular note is the under surface 23*b* of the upper leg 23 of adapter 22, because that is the surface in conjunction with which the electromechanical transducer operates.

Transducer housing assembly 40 includes an outer steel can 41 and an inner aluminum can 42. Aluminum can 42 has a plastic cap or cover 44 that mechanically protects the electrical circuitry within the housing assembly while permitting radio signals to escape to the exterior. The steel can 41 is welded in place as shown at 46. Inner can 42 is supported within the outer can by upper and lower grommets 47, 48, to protect the contents from excessive shock and vibration when the mining machine is in operation. The aluminum inner can 42 is removably inserted into the steel can 41. The use of a housing assembly of this kind provides a convenient modular concept in the installation and replacement of transducers.

Each transducer assembly 50 is housed within the aluminum inner can 42. A plunger housing 43 is also associated with and contained within the inner can 42. A flat printed circuit board 54, best seen in FIGS. 3 and 4, divides the interior of the aluminum can into two semi-cylindrical compartments. One such compartment receives a battery 56 and circuit board 54 while the other compartment receives the plunger housing 43.

The plunger housing 43 made of aluminum is in the form of an elongated cylinder with a large cylindrical opening in its bottom portion and a smaller cylindrical opening in its upper end. Cylindrical plunger 51 is slidably received within the smaller upper opening of housing 43. In the bottom portion of housing 43 a steel coil spring 52 is received, and a magnet 53 rests upon the top end of the coil spring. FIG. 3 shows the closed or retracted position of the plunger 51, while the adapter 22 remains attached in its normal operative position to the bucket, in which the spring 52 is compressed and plunger 51 engages the inner and under surface 23*b* of upper leg 23 of the adapter 22.

Battery 55 has wires connected to a switch 56, which is installed in or associated with the flat printed circuit board 54. An antenna circuit 57 is wired onto the side wall of circuit board 54 that faces toward the plunger compartment. Closing of the switch 56 will complete a circuit between battery 55 and antenna 57, to cause the antenna to generate a radio signal at a predetermined frequency.

The plunger housing 43 is spaced somewhat away from the circuit board 54. The battery 55, wires 58, and switch 56 in the battery compartment are encased in a floating relationship in a body of silicone 59, commonly known in the electronics industry as potting compound. Material of the same kind also fills spaces around the plunger housing 43.

The nature of switch 56 is that whenever the magnet 53 moves upward past the switch, even though there is no mechanical contact, the relative movement of the magnet causes the switch to close electrically, thereby energizing circuit board antenna 57.

The transmitters in all of the detector units are preferably set to operate at the same frequency to send signals 60, since the receiver 62 (FIG. 7) is most conveniently set to operate at only a single specified frequency. There is no need, however, to code the transmitter frequencies, since once the operator is alerted to the trouble by alarm device 65, he can determine visually which one of the adapters is breaking loose.

Each tooth 32 has upper and lower legs 33, 34, that fit over the nose 28 of the associated adapter, and the tooth is then secured by an attachment pin 30 through tooth attachment opening 29 to the associated adapter.

Operation

When adapter 22 starts to break loose from the leading edge of the bucket 14, the pressure on the outer end of plunger 51 is relieved, and the plunger then tends to fly outward, as shown in FIG. 6. During that movement the spring 52 expands, and magnet 53 moves past the switch 56, causing switch 56 to close. Closing of the switch causes the battery 55 to energize the antenna 57 on the circuit board 54. Once the plunger clears the opening of its housing, the antenna output signal 60 is freely transmitted through plastic cap 44 into the surrounding atmosphere, and reaches the operator's cab 12, where it is received by receiver 62.

Figure 7:
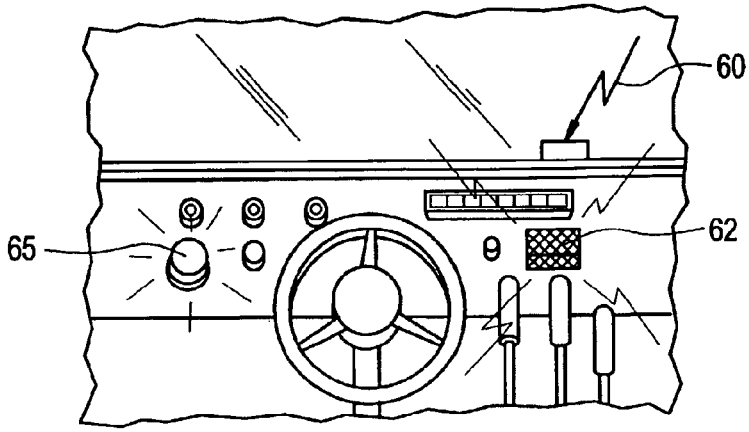
FIG. 7 is a fragmentary view of the instrument panel inside the operator's cab of the shovel machine, showing alarm devices associated with the radio receiver.

As shown in FIG. 7, the operator's cab is equipped with various alarm devices 65, both visual and aural, to inform the operator that an adapter is breaking loose. If loss of the adapter cannot be stopped, its tooth will go with it to the ore crusher.

Modified and Alternative Forms

It is not essential that the transmitter of each alarm unit be constructed integral with the associated mechanical part: Various kinds of electromechanical or electromagnetic transducers may be used to carry out the concept of the invention.

While we have disclosed the presently preferred embodiment of our invention in detail in order to comply with the requirements of the patent laws, it is to be understood that the scope of the invention and the protection herein sought is to be determined only in accordance with the appended claims.

What we claim is:

1. A method for preventing the unexpected loss of heavy mining equipment from metal separation comprising:

mechanically detecting the separation of a metal part from the leading edge of an excavator at an early stage by an embedded sensor;

generating a radio signal in response to the mechanical detection;

receiving the radio signal at a remote location; and generating a warning signal in response to the reception of the radio signal.

2. The method of preventing damage from the loss of heavy mining equipment when a portion is unexpectedly separated from an excavation machine, comprising the steps of:

selecting a monitoring station associated with the heavy mining equipment;

positioning a receiver at the monitoring station;

selecting an electromechanical transducer that is adapted to respond to the physical separation of the leading edge of the excavation machine;

placing a radio transmitter in operative relationship to the transducer wherein the transmitter generates a signal whenever the leading edge of the excavation machine has been at least partially separated from the excavator; and generating an alarm with sufficient promptness whenever the signal is received at the monitoring station so that further separation of the leading edge may be prevented.

3. In an open-pit mining operation in which ore is dug by a machine having a bucket with large tooth structures, in batches so large that an operator cannot by visual inspection determine their content, the method of preventing a tooth structure that is being unexpectedly separated from its bucket from being caught up in the ore and transported into an ore crusher along with the ore and thereby damaging the crusher, comprising the steps of:

selecting a monitoring station associated with the machine;

positioning a radio receiver at the monitoring station;

selecting an electromechanical transducer adapted to respond to physical separation of the tooth structure from its bucket;

placing a radio transmitter in operative relationship to the transducer;

positioning the transducer and its associated transmitter in a location for generating a signal from the transmitter whenever the tooth structure has been at least partially separated from the bucket; and whenever a signal is received at the monitoring station, generating an alarm with sufficient promptness that the further separation of the tooth structure may be stopped in time to prevent the tooth structure from being caught up in the crusher.

4. The method of claim 3 wherein the positions of the transmitter and receiver are chosen such that a signal may be successfully sent from the transmitter to the receiver even before a partial separation of the tooth structure has occurred.

5. Mining shovel apparatus comprising, in combination:

a mining machine having a large bucket operatively driven and controlled by the machine, the bucket having a leading edge;

a plurality of tooth adapters carried on the leading edge of the bucket, each tooth adapter being removably attached to the bucket leading edge;

a plurality of teeth, one for each tooth adapter, each tooth being removably attached to a respectively corresponding adapter;

a plurality of electromechanical transducers, each transducer being cooperatively associated with both a corresponding one of the adapters and its respectively associated tooth;

a plurality of radio transmitters, each being in operative relationship to a corresponding transducer;

a monitoring station associated with the mining machine;

a radio receiver positioned at the monitoring station;

each transducer being adapted to cause the associated transmitter to generate a signal whenever the associated tooth adapter is at least partially separated from the leading edge of the bucket; and the monitoring station having associated means responsive to a signal received from any one of the transmitters for generating an alarm with sufficient promptness that the further separation of the adapter may be stopped in time to prevent the adapter and its associated tooth from being caught up in the crusher.

6. The mining shovel apparatus of claim 5 wherein at least certain ones of the transducers include a pressure-sensitive switch positioned between interengaging surfaces of the associated adapter and the leading edge of the bucket; the switch then being operative in response to relative movement of the interengaging surfaces to active the associated transmitter.

7. A transducer in accordance with claim 6 which includes a housing recessed in one of the interengaging surfaces, a plunger normally positioned within the housing, and a spring inside the housing adapted to drive the plunger outward whenever separation of the interengaging surfaces starts to occur.

8. In an open-pit mining operation, the method of detecting the partial separation of a tooth from an excavation bucket, comprising the steps of:

placing an adapter between the leading edge of the excavation bucket and a tooth of the bucket wherein the adapter contains a spring-loaded switch and a transmitter, wherein the switch is adapted to expand upon the partial separation of the tooth from the adapter;

activating an electrical switch upon sufficient expansion of the spring-loaded switch; and activating the radio transmitter upon actuation of the electrical switch.

* * * * *